US005911761A

United States Patent [19]

Tilley

[11] Patent Number: 5,911,761

[45] Date of Patent: Jun. 15, 1999

[54] COMBINED STAPLER AND UTILITY KNIFE

[76] Inventor: James F. Tilley, 201 Main St., Pismo Beach, Calif. 93449

[21] Appl. No.: 09/063,435

[22] Filed: Apr. 21, 1998

[51] Int. Cl.[6] ..... B26B 11/00

[52] U.S. Cl. ..... 7/160; 7/158; 227/76; 227/120; 30/162

[58] Field of Search ..... 7/160, 170, 103, 7/158; 30/123, 162; 227/76, 120

[56] References Cited

U.S. PATENT DOCUMENTS

| | | | |
|---|---|---|---|
| 4,783,867 | 11/1988 | Tsao | 7/160 |
| 5,477,601 | 12/1995 | Jasmer | 7/158 |
| 5,511,262 | 4/1996 | Horng | 7/160 |

*Primary Examiner*—Timothy V. Eley
*Assistant Examiner*—Sinclair Skinner
*Attorney, Agent, or Firm*—Daniel C. McKown

[57] ABSTRACT

A type of stapler has a handle that permits it to be used like a hammer. The end of the handle is modified to permit it to receive the body of a utility knife. The latter is retained within the handle by a screw that replaces the screw which previously held the halves of the utility knife together. The blade-retracting lever of the utility knife is made accessible on the upper portion of the handle. The blade of the utility knife can be extended and retracted at the end of the tool opposite the staple-dispensing end of the stapler. The handle of the stapler serves as the handle of the utility knife. The tool thus formed is useful to persons who work with sheets of material that must be stapled to an underlying structure then trimmed to the shape of the structure and/or cut free from a roll of sheet material.

4 Claims, 1 Drawing Sheet

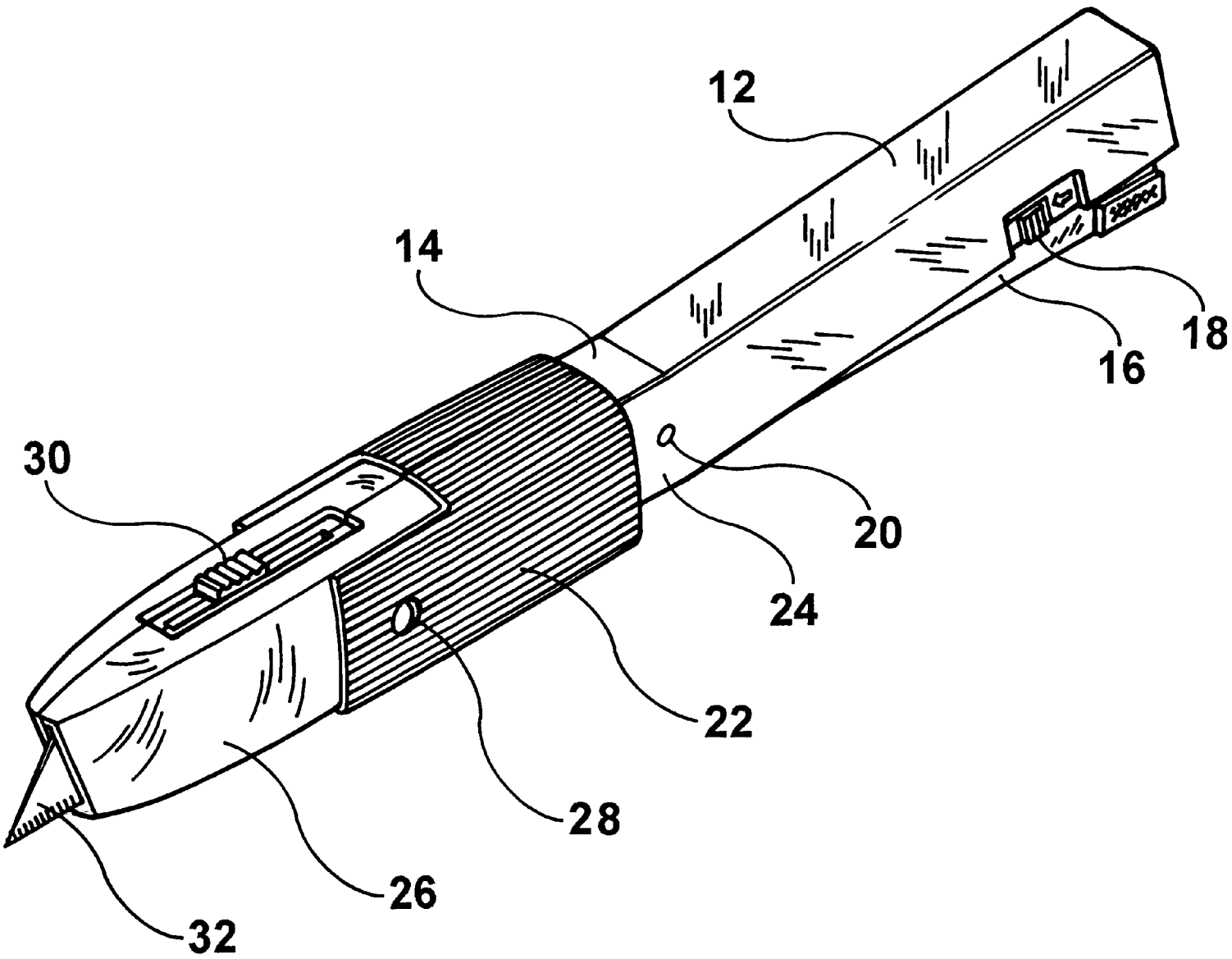
18
16
12
20
24
22
28
14
26
30
32

COMBINED STAPLER AND UTILITY KNIFE

BACKGROUND OF THE INVENTION

1. Field of the Invention

The present invention is in the field of hand tools, and specifically relates to a hand tool for stapling a sheet material to an underlying form, and then trimming the sheet material to the size and shape of the form.

2. The Prior Art

In U.S. Pat. No. 5,477,601, Jasmer shows and describes a combination staple gun and cutter for use in the installation of air-conditioning ductwork. Junctions of ductwork must be wrapped with tape which is stapled in position before being covered by a mastic coating. The fabric used to wrap the joints is a woven fiberglass that is supplied on spools. After stapling the fabric tape to a seam, the installer must cut the tape from the spool. Jasmer bolts a cutting edge to a stapler with the cutting edge extending along the side of the stapler, so that without releasing his grip on the stapler, the user can bring the cutting edge into contact with the tape and can cut the tape by pulling it against the cutting edge, all without pulling loose the newly-installed staples. While admirable for its purpose, the device has the disadvantage that the cutting blade cannot be retracted.

In U.S. Pat. No. 3,596,820, Kwong Li Lou describes a stapler that has been modified to feed reinforcing tape to one or both sides of the material being stapled, prior to stapling. A laterally-extending knife is pivotally attached to the front end of the actuator. After the staple has been driven, the knife blade is rotated into a vertical and lateral plane so that it cuts the tape when the actuating lever is depressed. This arrangement is particularly handy for cutting a tape that runs lengthwise within the stapler, but would not be convenient for trimming sheets of material that have been stapled to a frame.

In U.S. Pat. No. 4,783,867, Tsao describes a multi-functional stationery tool similar to a popular multi-use pocket knife. The tool includes a retractable blade and a retractable stapler. Both of these are located at the same end of the tool.

Utility knives have been combined with other tools as shown in the following patents: with a staple remover in U.S. Pat. No. 4,028,758 issued Jun. 14, 1977 to O'Connor; with a rotatable screen forming wheel in U.S. Pat. No. 4,910,821 issued Mar. 27, 1990 to Kieferle; with a tape measure in U.S. Pat. No. DES 372,183 issued Jul. 30, 1996 to Bourque; and, with a rasping blade in U.S. Pat. No. 5,519,908 issued May 28, 1996 to Steinman et al. None of these devices can perform satisfactorily the functions of the present invention.

BRIEF SUMMARY OF THE INVENTION

The type of stapler used in the present invention is not a conventional desk-top stapler that includes an anvil for crimping the staple. Instead, the stapler used in the present invention lacks an anvil because of the impossibility of inserting the object to be stapled into the jaws of the stapler. Instead, the stapler used in the present invention includes an actuator that melds at its rear end into a handle and includes a staple holder pivotally attached to the actuator. In use, the stapler is grasped by the handle and swung like a hammer. The inertia of the swing depresses the actuator relative to the staple holder driving home the uncrimped staple. Typically, such a stapler includes a rubber hand grip that covers the hollow metal handle of the stapler so that it can be securely grasped while being swung by one hand.

Such a stapler would ordinarily be used by someone in the construction trades. For example, when a house is being built, tarpaper may be stapled to the studs of an outside wall to cover the bulk insulation. Ordinarily the tarpaper is supplied in a roll, and after the tarpaper has been stapled to a stud, it may be desirable to cut the stapled portion free from the remainder of the roll. It is at this point that the benefit of combining the utility knife with the stapler can be seen. The utility knife fits conveniently in the hollow metal handle of the stapler, and is retained therein by a single screw that extends through the rubber hand grip of the handle of the stapler and extends through the utility knife, replacing the screw that is normally used to hold the halves of the utility knife together. The utility knife is mounted with its blade extending in a direction away from the dispensing end of the stapler.

The upper rear portion of the rubber hand grip is cut away to accommodate the sliding blade-retracting lever of the utility knife. Before cutting the sheet material, the user reverses his grip on the rubber handle and extends the blade of the utility knife to the cutting position. After the cut has been made, the blade is retracted, and the user reverses his grip in order to drive more staples.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE SEVERAL VIEWS OF THE DRAWING

The drawing is a top side perspective view showing a preferred embodiment of the present invention.

DETAILED DESCRIPTION OF THE INVENTION

The stapler portion of the invention includes an actuator 12 that extends from a handle 14. A staple holder 16 is pivotally mounted within the actuator by the pin 20. As a staple is dispensed, the staple holder 16 is forced into the actuator 12 against the resistance of an internal spring. A catch (not shown) prevents the staple holder 16 from swinging away from the actuator 12, but this catch can be defeated by sliding the release 18, thereby permitting the staple holder to rotate clockwise, as seen in the drawing, away from the actuator, so that the staple holder can be re-supplied with staples.

A rubber hand grip 22 normally covers the handle 14. The sides of the handle, of which the side 24 is typical, spread laterally to fit around the outside of the utility knife 26. The upper and lower surfaces of the handle 14 are cut away to permit the sides of the handle to be spread apart.

It is generally known that the body of the utility knife consists of two sides held together by a single screw. That screw is replaced by a longer screw 28 that extends through the rubber hand grip, the side 24 of the handle, the utility knife, the opposite side of the handle, and the opposite side of the rubber hand grip. If necessary, a portion of the rubber hand grip may be cut away to provide clearance for the sliding blade-retracting lever 30 of the knife. When the lever 30 is pushed away from the stapler, the blade 32 of the knife is extended in a direction away from the stapler, and when the lever 30 is drawn back toward the stapler, the blade 32 is retracted into the body of the knife 26.

Use of the combined stapler and utility knife is relatively straightforward. The user grasps the rubber hand grip 22 and swings the stapler toward the spot where the staple is to be placed. The staple holder hits this spot, and the inertia of the actuator drives the staple into the material. As the actuator and staple holder rebound, the staple holder returns to its original position with respect to the actuator.

At this point a number of other staples may be driven. After the last staple has been driven, the user reverses his grip on the rubber hand grip 22 so that his thumb is in a position to operate the sliding blade-retracting lever 30. The user then extends the blade and proceeds to cut the sheet material to the desired shape. Thereafter, the user retracts the lever 30 with his thumb, thereby leaving the tool in a safe condition and ready to drive another set of staples.

The device of the present invention is more convenient to use than a separate stapler and utility knife. The two are always together since they are intended to be used together. The rubber hand grip 22 serves as a grip for the utility knife as well as a grip for the stapler.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. In a stapler of the type having a handle that permits it to be swung like a hammer to drive staples through a sheet of material, the improvement comprising:

a knife blade extendable from and retractable into the end of the handle of the stapler so that the handle of the stapler serves as a handle for the knife blade.

2. A tool for cutting material in sheet form and for stapling the material to an underlying structure, comprising:

a stapler having a handle that permits it to be swung like a hammer to drive a staple through the material in sheet form, said handle having a free end; and, a knife blade extendable from and retractable into the free end of the handle of said stapler so that the handle of said stapler serves as a handle for said knife blade.

3. A tool for cutting material in sheet form and for stapling the material to an underlying structure, comprising:

a stapler having a handle that permits it to be swung like a hammer to drive a staple through the material in sheet form, said handle having a free end and having a left side and a right side;

a utility knife having a blade and having a body that includes two halves; and, means for mounting said utility knife in the handle of said stapler with the blade of said utility knife extendable from and retractable into the free end of the handle of said stapler so that the handle of said stapler serves as a handle for said utility knife.

4. The tool of claim 3 wherein said means further comprise a screw extending laterally through the right side of the handle, through the two halves of the body, and through the left side of the handle, to hold the halves of the body together and to secure said utility knife within the handle.

* * * * *